United States Patent [19]

Martinu

[11] 4,133,361

[45] Jan. 9, 1979

[54] METHOD FOR MACHINING JOINTS FOR MITERS, GROOVES AND OTHER JOINERY IN A BEVELED OR STRAIGHT PANEL EDGE AND APPARATUS FOR SAME

[75] Inventor: Jaroslav Martinu, Hickory Hills, Ill.

[73] Assignee: Woodwork Corporation of America, Chicago, Ill.

[21] Appl. No.: 654,101

[22] Filed: Feb. 2, 1976

[51] Int. Cl.[2] ..... B27C 1/02

[52] U.S. Cl. ..... 144/323; 90/15 R; 144/2 R; 144/114 R; 144/134 R; 144/136 R; 144/118 R; 144/309 L; 144/315 R; 144/318; 407/34

[58] Field of Search ..... 144/1 R, 2 R, 3 R, 41, 144/114 R, 115, 43, 44, 118, 119 R, 134 R, 136 R, 117 R, 117 B, 117 C, 124, 126, 127, 172, 173, 174, 175, 176, 218, 230, 231, 240, 309 R, 309 L, 314 R, 315 R, 321, 322, 323, 326 R, 229; 90/15 R; 407/31, 32, 33, 34, 36, 38, 39, 40, 51, 52, 53, 54, 55, 61, 62, 63, 64

[56] References Cited

U.S. PATENT DOCUMENTS

| | | | |
|---|---|---|---|
| 1,446,194 | 2/1923 | McCullough | 144/219 |
| 2,915,095 | 12/1959 | Pelto | 144/219 X |
| 2,920,663 | 1/1960 | March | 144/126 |
| 2,990,861 | 7/1961 | Macks et al. | 144/136 D |
| 3,039,503 | 6/1962 | Mainone | 144/229 X |
| 3,111,148 | 11/1963 | Herrmann et al. | 144/134 R |
| 3,228,267 | 1/1966 | Hebert | 407/34 |
| 3,713,194 | 1/1973 | Danly | 407/34 |

FOREIGN PATENT DOCUMENTS

| | | | |
|---|---|---|---|
| 602,345 | 9/1934 | Fed. Rep. of Germany | 144/119 R |

*Primary Examiner*—Othell M. Simpson
*Assistant Examiner*—W. D. Bray
*Attorney, Agent, or Firm*—Allegretti, Newitt, Witcoff & McAndrews

[57] ABSTRACT

Improved method and apparatus for machining the mitered edge surface of a composite material panel uses a multibladed cutting head rotatable about an axis of rotation that intersects the surface. The cutting blades are positioned transverse to the axis of rotation. Cutting is effected by shearing action of the blades across the surface, thereby eliminating sections of continuous wear on the blades. Blade life is extended and sound is reduced significantly. As an additional feature, a grooving bit may be included.

7 Claims, 15 Drawing Figures

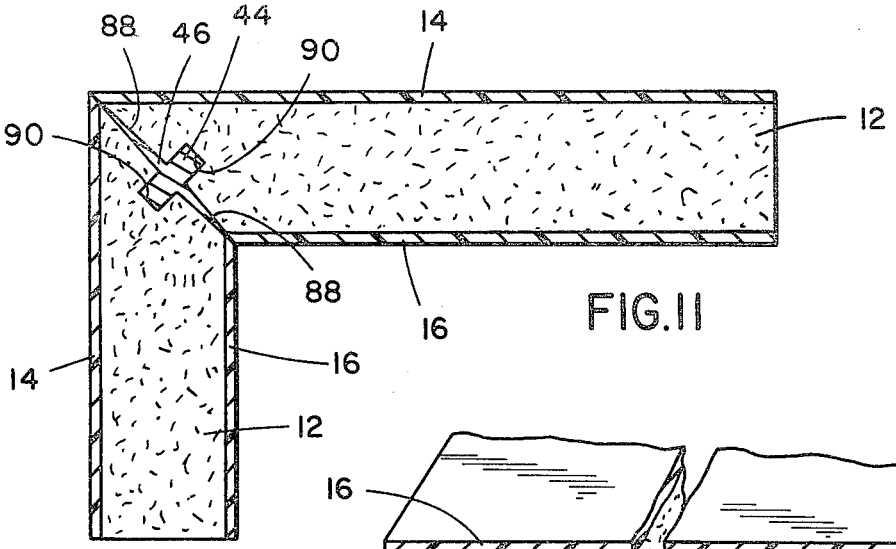
FIG.11
FIG.12
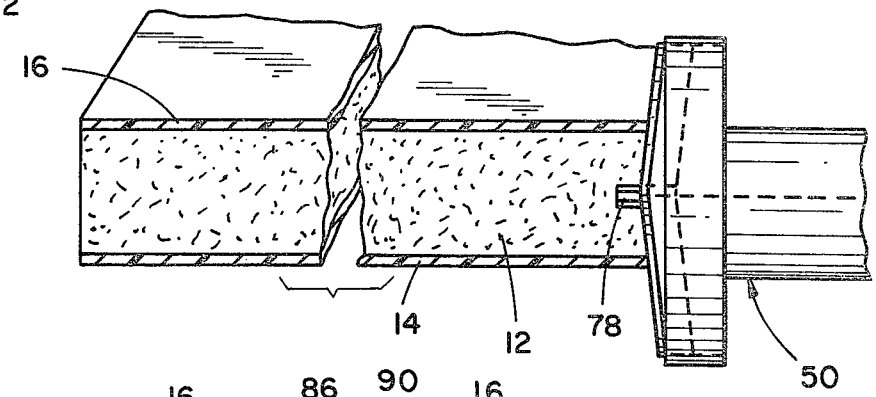
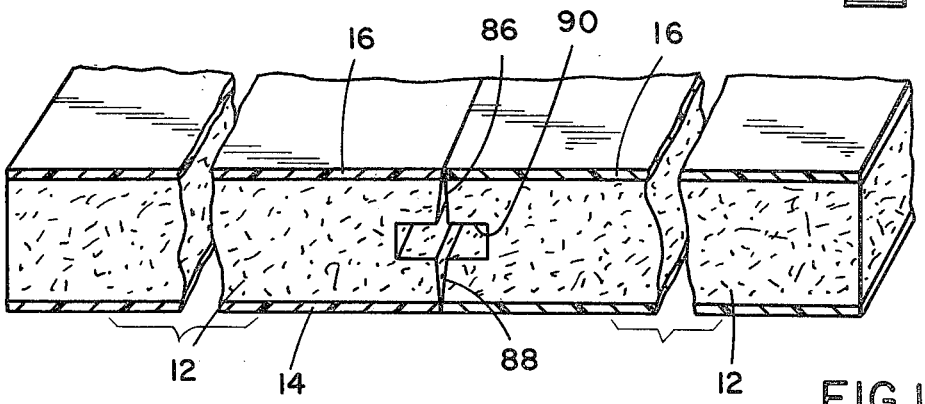
FIG.13
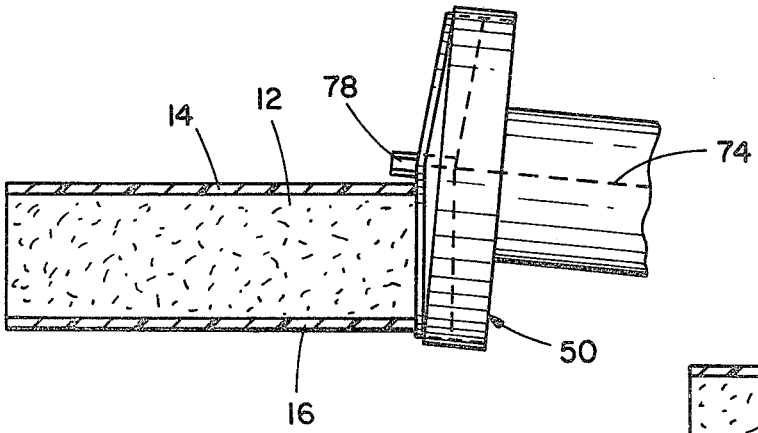
FIG.14
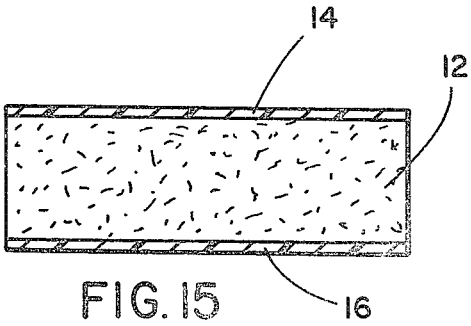
FIG.15

METHOD FOR MACHINING JOINTS FOR MITERS, GROOVES AND OTHER JOINERY IN A BEVELED OR STRAIGHT PANEL EDGE AND APPARATUS FOR SAME

BACKGROUND OF THE INVENTION

In a principal aspect, the present invention relates to a method for machining a surface and, more particularly to a method for matching an edge surface on a composite panel material.

Panels made of composite, multiple layered materials have many applications. Such panels may have a particleboard interior and decorative plastic outer surface layers. They may be used in the fabrication or manufacture of furniture, wall dividers and the like.

The manufacture of panels of this type requires many sequential cutting and shaping operations. For example, preparation of two panels to form a right angle requires cutting, preshaping, final shaping, grooving and sizing the edges of each panel. In the past, these operations have required at least four separate steps by various items of equipment. Thus, the panel is initially sized by operation of a saw or similar cutting device to within ½ inch of final dimension. Next, the edge of the panel is "hogged" and/or premitered to provide a generally acceptable panel edge. Subsequently, the panel is mitered, for example, by a machine described as either a shaper or double end tenoner using a planer type cutting head. A final operation provides a longitudinal groove in the panel edge for receipt of a spline which serves to align and strengthen the bond when the adjacent panel edges are glued together.

The prior art shaping operation is executed by a planer device which includes a number of blades mounted generally parallel to the rotation axis of a blade mounting assembly. The blades engage the edge surface which is being formed upon movement of the panel and planer head. The particular Bimex structure identified above provides two sets of blades which are movable parallel to the axis of rotation so that different parts of these blades may be brought into contact with material being machined. This reduces the wear on the blades and lengthens their life.

While the apparatus referenced above has proven quite workable especially for composite material panels, the effective life for blades of such assemblies is limited. For example, blades in a standard cutter head have been found to be useful for trimming approximately 100 to 120 feet of panel. The blades must then be removed, reversed, resharpened or otherwise refurbished after such limited use. Generally, the need for replacement of the blades occurs because of the variable hardness of the different components in the composite panels. This causes different degrees of wear of the blade edge. Moreover, since during the cutting operation, the blade engages generally the same part of the panel of same thickness, hard portions of the panels cause higher blade wear. Blade life is limited by the action of the hardest or most abrasive portion of the panel being cut.

In an effort to overcome these limitations associated with the prior art, the present method and apparatus were devised.

SUMMARY OF THE INVENTION

Briefly, the present invention relates to a method as well as apparatus for machining the surface of a material. The method provides for relative movement of the material being machined and the cutting mechanism for machining the surface. The cutting mechanism for cutting the surface includes at least one blade which is mounted in a blade assembly. The blade defines a cutting edge which lies in a plane substantially transverse to the axis of rotation of the cutting blade assembly. Preferably, the blade extends substantially radially outward from the rotation axis and provides a shearing action substantially in the plane perpendicular to the rotation axis of the blade. This shearing action constantly varies in the cutting plane. A plurality of blades may be utilized. A groove cutting bit may be also utilized in the combination.

It is thus an object of the present invention to provide a new and improved method for machining a surface of material, particularly the edge surface of a composite material.

A further object of the present invention is to provide a method for machining a surface wherein the blades utilized to form the surface do not establish any uniform wear pattern inasmuch as they are designed to utilize the entire blade edge in a constantly shearing and changing mode of engagement with the surface being machined.

It is a further object of the present invention to provide a method and device for machining panel edges having lower noise levels than prior art methods and apparatus.

Still another object of the present invention is to provide a surface cutting assembly and method which extends cutting the blade life relative to known methods and assemblies by ten or more times.

A further object is to provide a machined panel edge which is undercut to accommodate swelling of the panel material due to glue or adhesive application.

These and other objects, advantages and features of the invention will be set forth in the detailed description which follows.

BRIEF DESCRIPTION OF THE DRAWING

In the detailed description which follows, reference will be made to the drawing comprised of the following figures:

FIG. 11 is a cross-sectional view of two composite panel edges forming a right angle connection after being machined by the method and apparatus of the invention;

FIG. 12 is a cross-sectional view of a composite panel being machined to form a butt joint with a similar panel;

FIG. 13 is a cross-sectional view illustrating the positioning of two panels to form a butt joint;

FIG. 14 is a cross-sectional view of a composite panel being machined to form a right angle, flat cut; and FIG. 15 is a cross-sectional view of the panel cut in accordance with the method of FIG. 14.

DESCRIPTION OF THE PREFERRED EMBODIMENT

Figure 1:
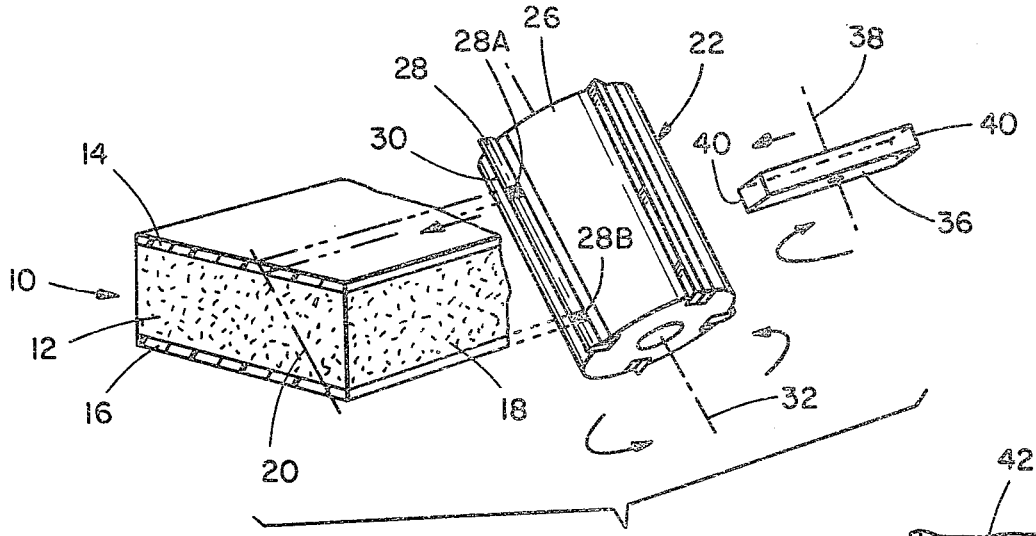
FIG. 1 PRIOR ART
FIG. 1 is a schematic view illustrating a typical prior art surface machining method and apparatus.
Figure 2:
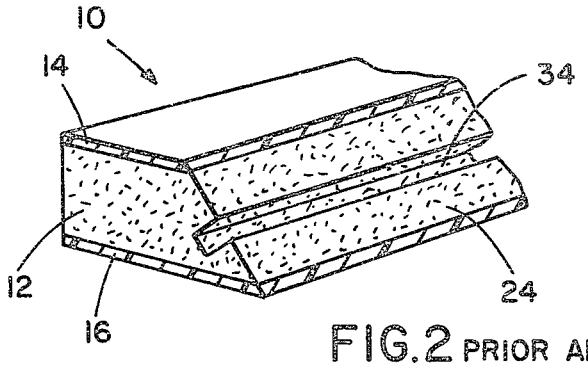
FIG. 2 PRIOR ART
FIG. 2 is a perspective view of a prior art panel edge form.
Figure 3:
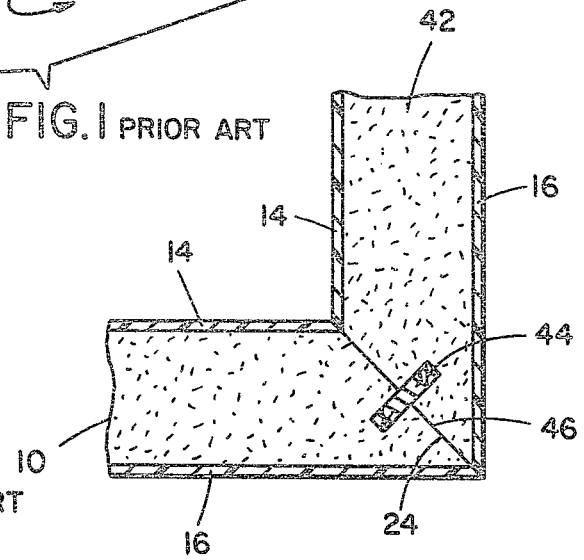
FIG. 3 PRIOR ART
FIG. 3 is a cross-sectional view of the manner in which two panels machined as shown in FIG. 2 are joined together to define a right angle.

FIGS. 1, 2 and 3 illustrate a typical composite material panel as well as the manner in which such panels have previously been machined. Each panel includes a miter and a groove to facilitate joining adjacent panels. Thus, as shown in FIG. 1, a panel 10 is comprised of particleboard or flake board 12 bonded on each side with plastic material layers 14 and 16. The density and hardness of the separate layers is variable. Generally, however, the outer layers are harder than the central layer 12. Additionally, other types of composite panels or materials may be provided. Also, a panel may be of a single solid material. FIGS. 1, 2 and 3 are merely illustrative of the many types of panels and materials available.

Heretofore, such panels have been formed in various sequential steps. First a cutting operation establishes panel size. Such a cutting operation will, for example, define surface 18 as shown in FIG. 1. A subsequent presizing operation along the dotted line 20 in FIG. 1 defines the general surface for joining the panel 10 with another panel or part.

Subsequent to the presizing operation, a planer device 22 forms a final finished, flat surface 24 shown in FIG. 2. The planer device 22 includes a head assembly 26 having a plurality of blades 28. Blades 28 include blade edges 30 which rotate about the axis 32 as illustrated in FIG. 1. This is a typical prior art planer device. Shaded blade sections 28A and 28B cut the plastic layers 14, 16 of the panel.

Alternate forms of this device segment the blades 28 so that between planing operations the segmented blades may be moved relative to each other and parallel to the axis 32. As a result, different portions of the blades 28 are made to engage the plastic material 14 and 16 and particleboard 12. This technique distributes the wear of the planing operation over the surface of the blades 28. In any event, during a cutting operation, blade wear due to cutting layers 14, 16 is limited to sections such as sections 28A and 28B in FIG. 1.

Subsequent to formation of surface 24, a separate operation is required to form the groove 34. This separate operation is also illustrated schematically in FIG. 1. As shown in that figure, a miter cutter or blade 36 is driven about axis 38 so that blade edges 40 may cut groove 34 as blade 36 is moved relative to panel 10. The resultant product is a panel 10 as shown in FIG. 2 which is shaped, grooved and available to be joined with a similarly shaped panel as shown in FIG. 3.

Referring to FIG. 3, a first panel 10 and a second panel 42 each include surfaces 24 which have been mitered. A spline 44 engages grooves 34. Glue or adhesive material 46 is inserted into the region between surfaces 24 to effect joining of the panels 10 and 42. It is noted that the outside surfaces of the plastic material 14 and 16 abut firmly to define a clean line of engagement. Preferably, the miter surfaces 24 are, however, undercut somewhat in order to form a space for the expansion or swelling of the wood fibers when wetted with glue or adhesive 46. This undercutting operation may be effected by a blade similar to blade 36 in a separate but additional operation. Space for expansion of the fibers when wetted by glue 46 is, however, a very desirable feature, allowing a tight joint to be effected.

The remaining figures illustrate the method and apparatus of the present invention which method and apparatus in a single step automatically forms a panel edge. The edge formation combines numerous separate steps required by the prior art and does so with less blade wear and lower noise.

Referring to FIGS. 4 through 7, the cutting blade and support structure of the present invention is illustrated. The structure includes a blade assembly 50 including a blade holder 52 with a removable collar 54 and an attached spindle 56. The holder 52 includes three slots 58, 59 and 60. Each slot 58, 59, 60 receives a single cutting blade 62, 63 and 64 respectively.

Figure 7:
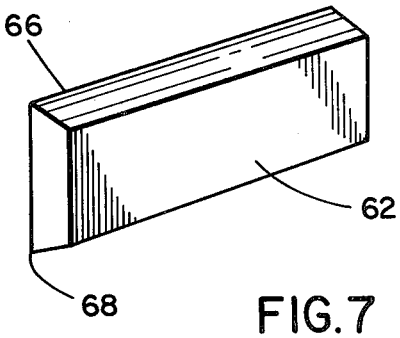
FIG. 7 is an enlarged perspective view of a typical blade used in the assembly and for the method of the present invention.

The blades 62, 63 and 64 are of the construction shown in FIG. 7. Blade 62 includes a cutting edge 66 which, in the embodiment shown, is a straight edge. The straight edge 66 is not a limitation of the invention since the edge 66 of the blade 62 may be of any desired configuration. In the embodiment shown, the blade 62 is reversible. Thus, in addition to the cutting edge 66, a second cutting edge 68 is defined.

Figure 6:
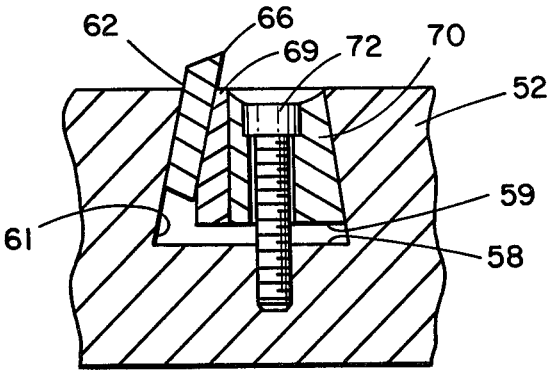
FIG. 6 is a cross-sectional view taken along the line 6—6 in FIG. 5.

Referring to FIG. 6, groove 58 includes inclined side walls 59, 61 and is cooperative with a fastening member 69 and a blade retention member 70 screwed into the groove 58 by one or more fasteners 72. Each of the blades 62 is held in position in similar fashion with the cutting edge, e.g. cutting edge 66, exposed for cutting above the surface of holder 52.

Figure 4:
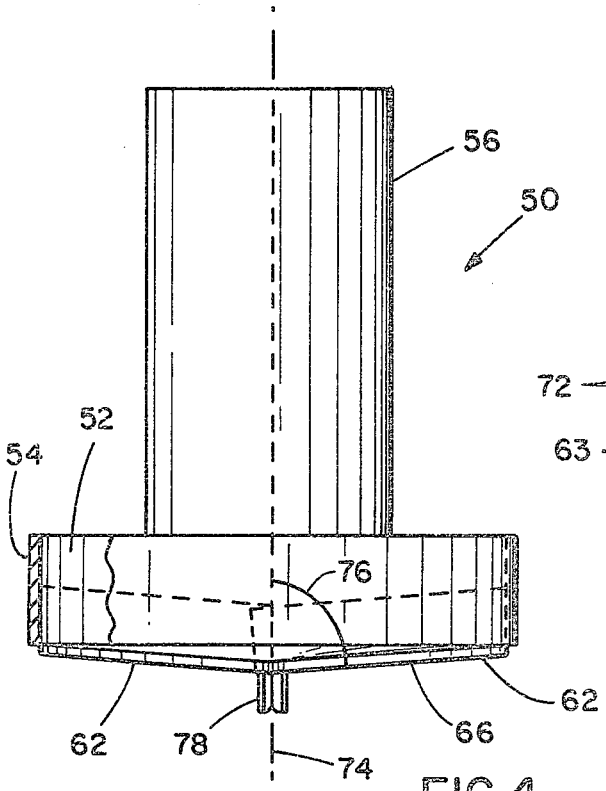
FIG. 4 is a plan view of the improved cutter head assembly of the present invention.
Figure 5:
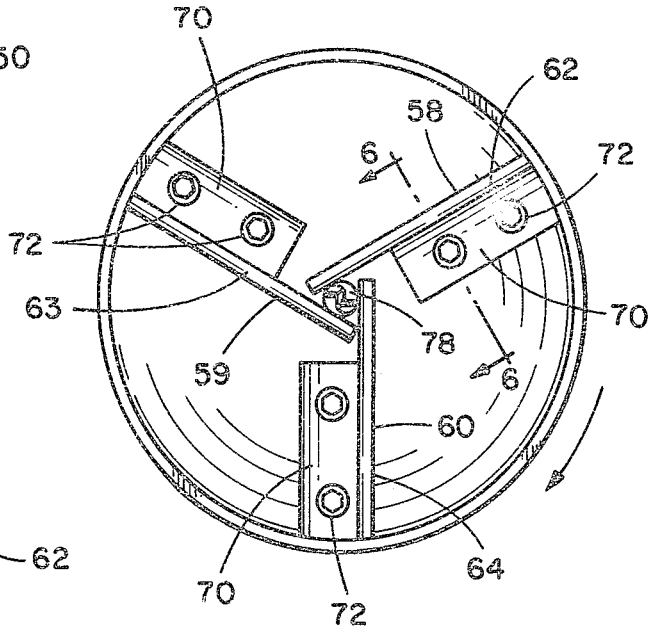
FIG. 5 is an end view of the improved assembly shown in FIG. 4.

As illustrated in FIGS. 4 and 5, the spindle 56 and holder 52 define a rotation axis 74 for the mechanism. Blades 62, 63 and 64 extend substantially radially outward from the axis 74. In the embodiment illustrated, blades 62, 63, 64 are inclined to define an acute angle 76 between the blade edge, as at blade edge 66, and axis 74. The angle 76 may be perpendicular, acute as shown, or obtuse depending upon the shape of the panel which is being formed. In general, the angle 76 is approximately 85°–88° and this constitutes the preferred embodiment.

As shown in FIG. 5, each of the blades 62, 63 and 64 are eccentric relative to the axis 74. That is, the blades 62, 63 and 64 define chords relative to axis 74 and do not extend exactly radially outward from the axis 74. Rather, they are offset from that axis by a slight amount, preferably in the range of 2°–5°. This improves the shearing action associated with the assembly of the present invention. Additionally, this permits insertion of a groove cutting bit 78 along the axis 74. The bit 78 is of a type known to those skilled in the art. Circumferential collar 54 retains the blades 62, 63 and 64 against outward force imparted thereon when the holder 52 is rotated for example in the direction illustrated by the arrow in FIG. 5.

Figure 8:
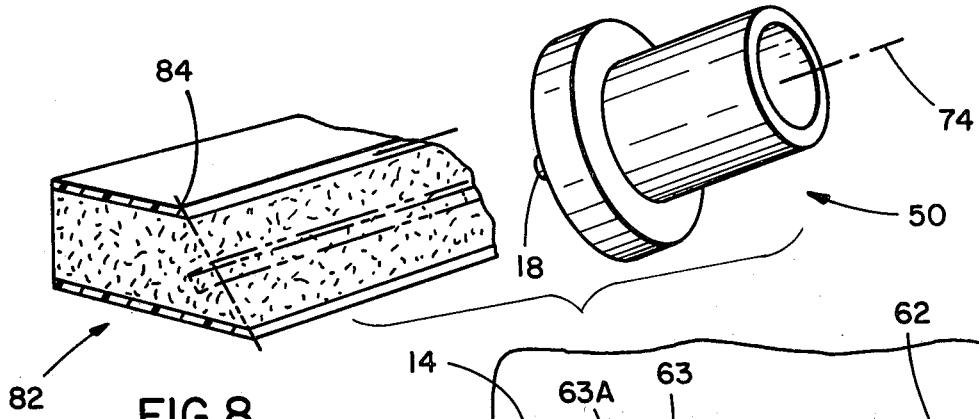
FIG. 8 is a schematic view illustrating the improved method and apparatus of the present invention.
Figure 9:
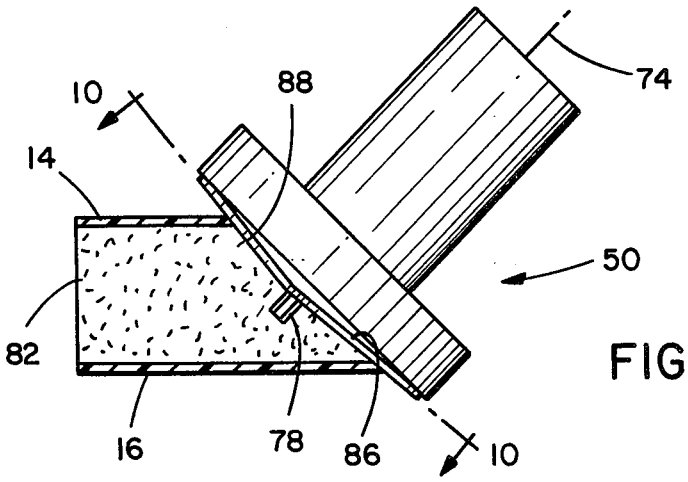
FIG. 9 is a cross-sectional view of a composite panel being machined in accordance with the method by the apparatus of the present invention.

FIGS. 8 and 9 further illustrate the method of the invention. A panel 82 is premachined along a surface defined by line 84 in the manner described relative to the prior art above. As with the prior art, the panel 82 moves in the direction of the surface being formed. Alternatively, it should be noted that the assembly 50 may be moved in such direction to effect the surface machining operation.

Figure 10:
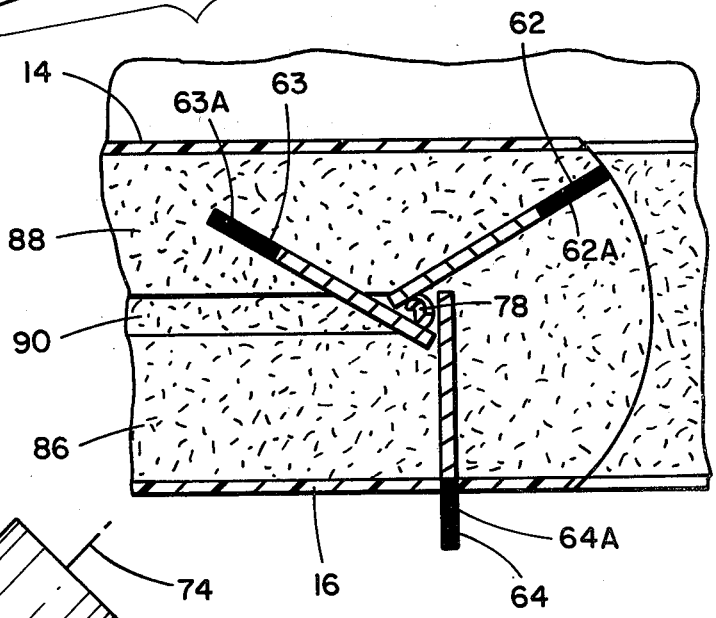
FIG. 10 is a cross-sectional view of the operation of the device of the present invention taken along the line 10—10 in FIG. 9.

Subsequent to premachining of the general configuration of the surface, the assembly 50, which is driven rotationally about axis 74 as shown in FIGS. 8 and 9, is brought into contact with the panel 82. FIG. 9 illustrates the cross section of engagement between the assembly 50 and the panel 82. The blades 62, 63 and 64 sweep or shear over the surface which is being cut. The edges 66 of the blades thus engage different portions of the edge of panel 82. In this manner, no particular portion of the blade and, in particular blade edge 66, is made to wear. FIG. 10 illustrates the portions of blades 62, 63, 64 which cut the layers 14, 16. Thus, shaded portions 62A, 63A and 64A sweep over the layers 14, 16. Blade wear is extended because the blades 62, 63, 64 constantly sweep over the layers 14, 16 at differing angles and over a longer range of the blade edge 66.

Also, because the blades 62, 63 and 64 are inclined relative to axis 74, first and second miter surfaces 86 and 88 which intersect at some obtuse angle are formed. This provides for the region of receipt of glue or adhesive. Additionally, when the adhesive is placed adjacent the surfaces 86, 88, the fibers forming the panel 10 swell. The bevel or undercut accommodates this swelling. Bit 78 simultaneously forms groove 90.

A plurality of blades 62, 63, 64 have been illustrated although it is possible to perform the method and construct the assembly of the present invention with a single blade. Additionally, the blades 62, 63, 64 have been shown to be eccentric or off center of axis 74. The blades 62, 63, 64 may also extend through the axis 74, though this is not the preferable embodiment. The blades 62, 63, 64 have straight edges shown in the drawing, although this again is not a limitation. The use of a bit 78 is also optional.

With the structure of the present invention, it is possible to provide an enormous increase in blade life. Experiments conducted so far have indicated a blade life of 20 to 30 times the blade life associated with present panel edge machining devices. Additionally, the sound level associated with the structure of the present invention is significantly lower than that of known prior art assemblies.

FIGS. 11 through 15 illustrate various cuts which may be made utilizing the structure previously described. Referring first to FIG. 11, two panels formed by the machining operation illustrated by FIG. 9 may be joined to form a right angle. Note that the beveled surfaces 86 and 88 define a space for receipt of the glue material 46 and accommodate any swelling of the fibers. A spline 44 is inserted into the groove 90.

In FIG. 12, the cutter head 50 forms a panel edge surface which may be joined with another panel edge surface to form a butt joint as illustrated in FIG. 13. Again, the beveled surfaces 86 and 88 accommodate expansion of the middle layer 12.

FIG. 14 illustrates the manner in which the cutter 50 may be used to form a plain, unbeveled surface in the edge of the panel. In this case, the cutting is done to one side of the center line 74 of the cutter head 50. The miter bit 78 is not used in this instance. FIG. 15 illustrates in cross section the resultant cut.

Thus, while there has been set forth a preferred embodiment of the present invention, it is to be understood that the invention shall be limited only by the following claims and their equivalents.

What is claimed is:

1. An improved method for machining a projected surface of material comprising the steps of:

engaging the material with the cutting edge of a cutting blade, said blade being rotated about an axis intersecting the projected surface, said blade edge extending substantially radially outward from the axis of rotation;

translating the material relative to the blade edge along a path defining the surface whereby the blade edge cuts and shapes the surface by a shearing action of said blade edge upon the material, the angle of shear being constantly varied in a plane perpendicular to the rotation axis of the blade as the blade is rotated; and simultaneously machining a groove in said surface along the axis of rotation.

2. The improved method of claim 1 including the step of engaging a plurality of blades with the material, each of the blades being rotated about the axis of rotation and extending substantially radially outward from that axis.

3. The improved method of claim 1 including the step of positioning the blade with a cutting edge eccentric with the axis of rotation.

4. The method of claim 1 wherein the material cutting blade comprises a blade having a straight edge for cutting a planer surface having a clean, flat appearance.

5. The improved method of claim 1 including the step of engaging the material with the cutting edge of the cutting blade wherein the cutting blade is set to define an acute angle between the axis of rotation and the blade edge.

6. The improved method of claim 1 including the step of engaging the material with the cutting edge of the cutting blade wherein the blade edge is inclined from the perpendicular to the axis of rotation.

7. The improved method of claim 1 including the step of cutting the material to form intersecting surfaces which undercut the edge of the panel and define a region to accommodate swelling of panel material.

* * * * *